US011331669B2

(12) United States Patent
Kornilovich et al.

(10) Patent No.: US 11,331,669 B2
(45) Date of Patent: May 17, 2022

(54) MICROFLUIDIC NETWORK

(71) Applicant: Hewlett-Packard Development Company, L.P., Spring, TX (US)

(72) Inventors: Pavel Kornilovich, Corvallis, OR (US); Alexander Govyadinov, Corvallis, OR (US); Nick McGuinness, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 269 days.

(21) Appl. No.: 16/477,772

(22) PCT Filed: Feb. 15, 2017

(86) PCT No.: PCT/US2017/017983

§ 371 (c)(1),
(2) Date: Jul. 12, 2019

(87) PCT Pub. No.: WO2018/151724

PCT Pub. Date: Aug. 23, 2018

(65) Prior Publication Data

US 2019/0366339 A1 Dec. 5, 2019

(51) Int. Cl.
*B01L 3/00* (2006.01)

(52) U.S. Cl.
CPC ... *B01L 3/502738* (2013.01); *B01L 3/502715* (2013.01); *B01L 3/502723* (2013.01);
(Continued)

(58) Field of Classification Search
CPC ..... B01L 3/502738; B01L 3/502715; B01L 3/502723; B01L 3/502746;
(Continued)

(56) References Cited

U.S. PATENT DOCUMENTS 6,911,183 B1 6/2005 Handique
7,958,906 B2 7/2011 Cardenas-Valencia et al.
(Continued)

FOREIGN PATENT DOCUMENTS

WO WO-2010040103 A1 4/2010
WO 2014051427 4/2014
WO 2017180120 10/2017

OTHER PUBLICATIONS

Neumann, C et al., Design and Characterization of a Platform for Thermal Actuation of Up to 588 Microfluidic Valves, Aug. 3, 2012, http://link.springer.com/article/10.1007/s10.

*Primary Examiner* — Jennifer Wecker
*Assistant Examiner* — Oyeleye Alexander Alabi
(74) *Attorney, Agent, or Firm* — Dicke Billig & Czaja PLLC

(57) ABSTRACT

An apparatus may include a first microfluidic valve coupled between a first reservoir and a fluid channel. The first microfluidic valve may include a fluid agitator to break a meniscus formed at an air-fluid interface and release fluid from the first reservoir into the fluid channel in response to an electrical signal. The apparatus may also include a second microfluidic valve coupled between a second reservoir and the fluid channel. Fluid from the first reservoir and fluid from the second reservoir mix in the fluid channel.

20 Claims, 9 Drawing Sheets

(52) U.S. Cl.
CPC . *B01L 3/502746* (2013.01); *B01L 2200/0621* (2013.01); *B01L 2300/0861* (2013.01); *B01L 2400/0439* (2013.01); *B01L 2400/0442* (2013.01); *B01L 2400/082* (2013.01)

(58) Field of Classification Search
CPC ..... B01L 2200/0621; B01L 2300/0861; B01L 2400/0439; B01L 2400/0442; B01L 2400/082; B01L 2300/0867; B01L 2400/0688; B01L 2400/0694
See application file for complete search history.

(56) References Cited

U.S. PATENT DOCUMENTS

| | | | | |
|---|---|---|---|---|
| 9,254,486 | B2 | 2/2016 | Imran | |
| 2003/0196714 | A1 | 10/2003 | Gilbert et al. | |
| 2004/0037739 | A1* | 2/2004 | McNeely | B01L 9/527 422/417 |
| 2004/0258569 | A1 | 12/2004 | Yamazaki | |
| 2005/0217743 | A1* | 10/2005 | Bohm | A61B 5/150213 137/828 |
| 2007/0091133 | A1 | 4/2007 | Chou et al. | |
| 2008/0280285 | A1* | 11/2008 | Chen | B01L 3/502715 435/5 |
| 2015/0328637 | A1 | 11/2015 | Perrault et al. | |
| 2016/0263577 | A1 | 9/2016 | Ismagilov et al. | |

* cited by examiner

MICROFLUIDIC NETWORK

RELATED APPLICATIONS

This application is related to the following the commonly assigned co-pending patent applications entitled, "MICROFLUIDIC VALVE", PCT/US2017/017968, which is filed contemporaneously herewith and is incorporated herein by reference.

BACKGROUND

Microfluidics relates to the behavior, precise control and manipulation of fluids that are geometrically constrained to a small, typically sub-millimeter, scale. Numerous applications employ passive fluid control techniques such as capillary forces. In some applications, external actuation techniques are employed for a directed transport of fluid. For example, in some situations, rotary drives may be implemented to apply centrifugal forces.

Active microfluidics refers to a defined manipulation of the working fluid by active (micro) components such as micropumps or microvalves. Micropumps supply fluids in a continuous or intermittent manner for application such as for dosing of medicine. Microvalves determine the flow direction and/or the mode of movement of pumped liquids. In some examples, processes which are executed in a lab are miniaturized on a single chip in order to enhance efficiency and mobility as well as reducing sample and reagent volumes.

A lab-on-a-chip (LOC) is a device that integrates one or several laboratory functions on a single microelectronic/microfluidic chip that occupies millimeters to a few square centimeters to achieve automation and high-throughput screening. LOCs deal with the handling of small fluid volumes down to less than several picoliters (pL). Lab-on-a-chip devices are a subset of Micro-electro-mechanical systems (MEMS) devices and often referred to as "Micro Total Analysis Systems" (μTAS) as well.

DETAILED DESCRIPTION

This disclosure relates to a microfluidic valve network, which may be referred to as a microfluidic network. In some examples, the microfluidic network includes a first microfluidic valve that is connected between a first fluid reservoir and a fluid channel. A fluid-air interface is formed at an end of the first microfluidic valve and the fluid channel. A first meniscus of fluid from the first reservoir is formed at the fluid-air interface of the first microfluidic valve. A fluid agitator is positioned in the first microfluidic valve and is in contact with the fluid from the first reservoir. The fluid agitator is actuated by an electrical signal. The fluid agitator may be, for example, an electromechanical device (e.g., a piezoelectric device) or an electrical device (e.g., a thermal ink jet (TIJ) resistor). Upon actuation, the fluid agitator may agitate (e.g., heat or vibrate) fluid in the valve causing the fluid to break the first meniscus, allowing fluid from the first fluid reservoir to flow into the fluid channel.

In some examples, the microfluidic network also includes a second microfluidic valve that is coupled to a second microfluidic reservoir and the fluid channel. A second meniscus of fluid is formed at the fluid-air interface of the second microfluidic valve. In at least one example, the second microfluidic valve includes a fluid agitator that may also be actuated by an electrical signal to agitate fluid in the second microfluidic valve, causing the fluid to break the second meniscus. This allows fluid to flow from the second reservoir into the fluid channel. In at least one other example, the second microfluidic valve omits the fluid agitator. In this example, the fluid flowing from the first reservoir and into the fluid channel flows into the second meniscus, thereby breaking the second meniscus and causing fluid to flow from the second reservoir into the fluid channel. In either example, fluid from the first reservoir and fluid from the second reservoir is mixed together in the fluid channel.

In some examples, the fluid channel coupled to the first and second microfluidic valves may include a vent to allow air to flow out of the fluid channel, thereby drawing fluid from the first and second reservoirs into the fluid channel. Moreover, a time of the mixing may be controlled by the electrical signal (or multiple electrical signals). Many different configurations are possible for the microfluidic network. For instance, more than two microfluidic valves and/or multiple fluid channels may be employed to precisely control a sequence of mixing actions to result in a fluid with a particular volume and/or composition.

Figure 1:
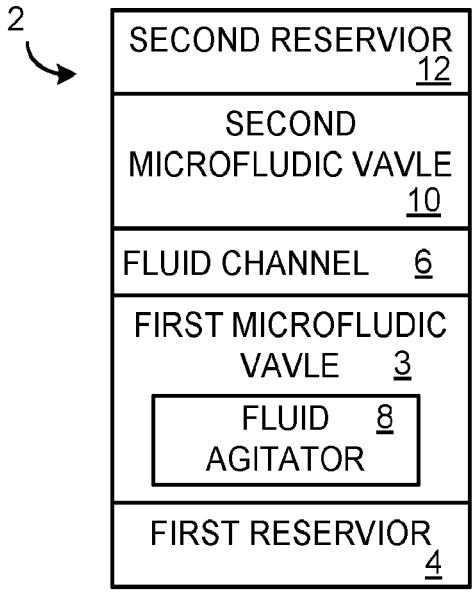
FIG. 1 illustrates a diagram of an example of a microfluidic network.

FIG. 1 illustrates an example of a microfluidic network 2. The microfluidic network 2 may include a first microfluidic valve 3 coupled between a first reservoir 4 and a fluid channel 6. The first microfluidic valve 3 may include a fluid agitator 8 to break a meniscus formed at an air-fluid interface and release fluid from the first reservoir 4 into the fluid channel 6 in response to an electrical signal. The microfluidic network 2 may include a second microfluidic valve 10 coupled between a second reservoir 12 and the fluid channel 6. Fluid from the first reservoir 4 and fluid from the second reservoir 12 mix in the fluid channel.

Figure 2:
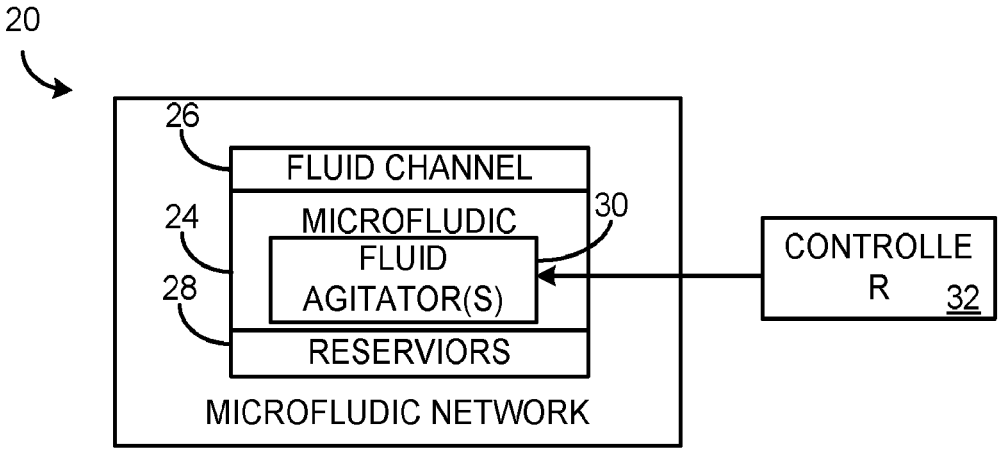
FIG. 2 illustrates a block diagram of an example of a microfluidic network.

FIG. 2 illustrates a block diagram of a microfluidic network 20. The microfluidic network 20 includes at least two microfluidic valves 24 coupled between a fluid channel 26 and respective reservoirs 28. In a rest state, fluid from each respective reservoir 8 is held by a meniscus of fluid formed at an end (opening) of the respective reservoir 8. The microfluidic network 20 could be implemented as a "lab-on-a-chip" (LOC) device.

At least one of the microfluidic valves 24 includes a fluid agitator 30, which may be implemented as an electrical device (e.g., a TIJ resistor) or as an electromechanical device (e.g., a piezoelectric device). Each fluid agitator 30 may be actuated by an electrical signal. In examples where there is more than one fluid agitator 30, each fluid agitator 30 may be actuated by the same or different electrical signals to transition the microfluidic network from the rest state to an active state. Upon actuation, each fluid agitator 30 heats or vibrates fluid in a corresponding microfluidic valve 24 to break the meniscus of the corresponding microfluidic valve 24 and allow fluid to flow from a corresponding reservoir 8 into the fluid channel 26. Thus, in the active state, fluid freely flows into the fluid channel 26.

In some examples, a given microfluidic valve 24 includes the fluid agitator 30 and another microfluidic valve 24 omits the fluid agitator 30. In this situation, upon actuation of the fluid agitator 30 of the given microfluidic valve 24, fluid flows from a given (corresponding) reservoir 8 into the fluid channel 26 and contacts and breaks the meniscus of fluid formed at the other microfluidic valve 24 and allows fluid to flow from another (corresponding) reservoir 8 into the fluid channel 26.

A controller 32 may be programmed to provide the electrical signal to each fluid agitator 30. In some examples, the controller 32 may be a microcontroller or a field programmable gate array (FPGA) with input/output (I/O) pins for providing the electrical signals to the fluid agitators 30. In other examples, the controller 32 may be, for example, a computing device (e.g., a desktop computer, a laptop computer or server). In some situations, the controller 32 may actuate a first set (e.g., one or more) of the fluid agitators 30 in a first time period and the controller 32 may actuate a second set (e.g., one or more) of the fluid agitators 30 in a second time period to allow a delay between release fluids in the reservoirs 28.

By employment of the microfluidic network 20, tight controls of a timing, volume and/or composition of a resultant fluid in the fluid channel 26 may be achieved. In some examples, flowing the fluids from the reservoirs 28 into the fluid channel 26 may initiate a chemical reaction. In other examples, the fluids flowing from the reservoirs 28 into the fluid channel 26 may be mixed together to achieve a specific dilution rate (composition) for the resulting fluid in the fluid channel 26.

Figure 3A:
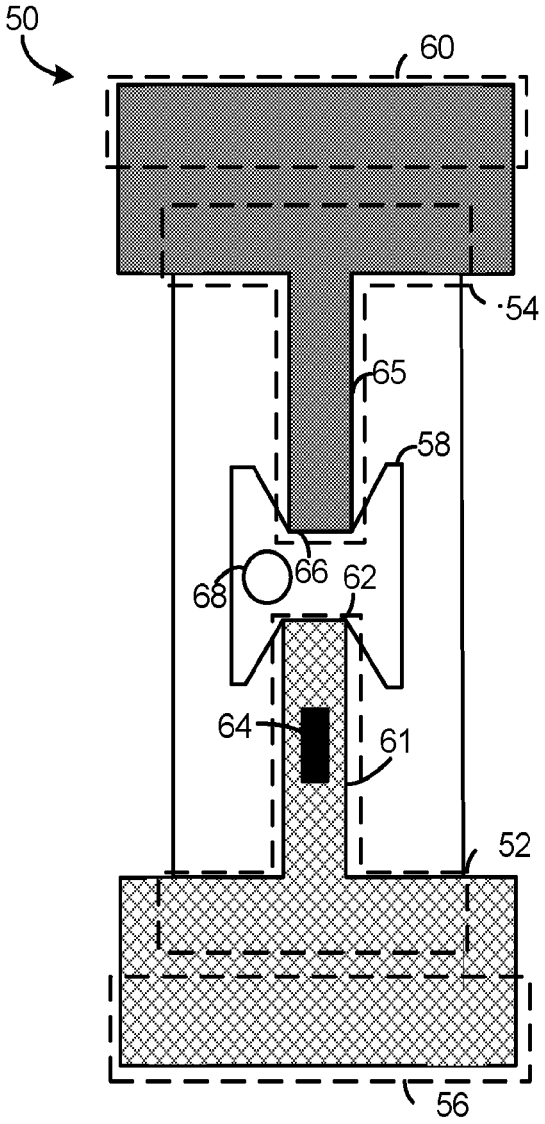
FIGS. 3A and 3B illustrate a diagram of an example of a microfluidic network.
Figure 3B:
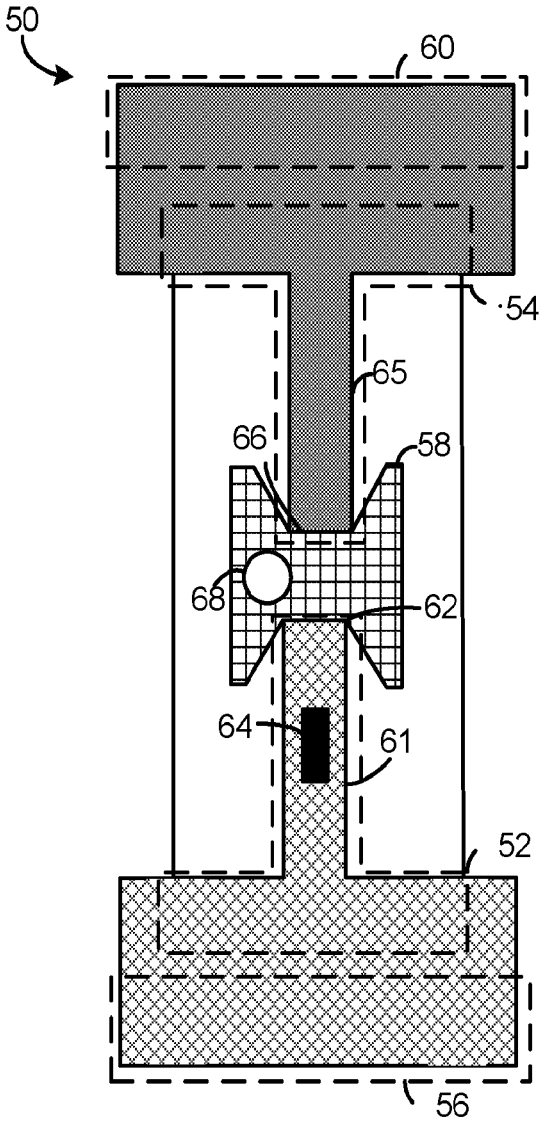

FIG. 3A illustrates a diagram of a microfluidic network 50 in a rest state. FIG. 3B illustrates a diagram of the microfluidic network 50 in an active state. The microfluidic network 50 may be employed to implement the microfluidic network 20 of FIG. 2. The microfluidic network 50 may be implemented in a microelectronic chip, such as an LOC system. In some examples, the microfluidic network 50 includes a first microfluidic valve 52 and a second microfluidic valve 54. The first microfluidic valve 52 may be coupled between a first reservoir 56 and a fluid channel 58. The second microfluidic valve 54 may be coupled between a second reservoir 60 and the fluid channel 58. The fluid channel 58 may be filled with an inert gas, such as air, nitrogen, etc.

The first reservoir 56 provides fluid to the first microfluidic valve 52. The first microfluidic valve 52 may include a capillary tube 61 (or other elongated structure) that allows the flow of the fluid from the first reservoir 56 to an air-fluid interface at an end 62 of the first microfluidic valve 52. A meniscus of fluid forms at the air-fluid interface at the end 62 of the first microfluidic valve 52 and Laplace pressure generated by the meniscus prevents fluid from flowing in the fluid channel 58.

A fluid agitator 64 may be positioned in the capillary tube 61. The fluid agitator 64 may be in physical contact with the fluid present in the capillary tube 61 of the first microfluidic valve 52. The fluid agitator 64 may be actuated by an electrical stimulus, such as an electrical signal provided from a controller (not shown).

In some examples, the fluid agitator 64 may be implemented as an electrical device, such as a TIJ resistor. In such a situation, upon actuation by the electrical signal, the fluid agitator 64 heats the fluid in the capillary tube 61, forming a vapor bubble. The resultant vapor bubble applies pressure on the meniscus formed that the end 62 of the first microfluidic valve 52 and (upon sufficient pressure being built), breaks the meniscus, thereby allowing fluid to flow from the first reservoir 56 into the fluid channel 58 to transition the first microfluidic valve from a closed state to an open state.

More particularly, in examples where the fluid agitator 64 heats the fluid, the fluid agitator 64 may vaporize a (relatively small) portion of fluid in the capillary tube 61 in a timeframe of about one microsecond. The increased pressure of the vapor ("a drive bubble") breaks the meniscus formed at the end 62 of the first microfluidic valve 52. In this manner, the mechanism for breaking the meniscus is similar to droplet ejection in an inkjet printer.

In other examples, the fluid agitator 64 may be implemented as an electro-mechanical device, such as a piezoelectric device (e.g., a crystal oscillator). In such a situation, upon actuation by the electrical signal, the fluid agitator 64 vibrates (oscillates) and applies pressure on the meniscus formed at the end 62 of the first microfluidic valve 52. Upon sufficient pressure being built by the vibration of the fluid agitator 64, the meniscus breaks, thereby allowing fluid to flow from the first reservoir 56 into the fluid channel 58.

The second reservoir 60 provides fluid to the second microfluidic valve 54. The second microfluidic valve 54 may include a capillary tube 65 (or other elongated structure) that allows the flow of the fluid from the second reservoir 60 to an air-fluid interface at an end 66 of the second microfluidic valve 54. A meniscus of fluid forms at the air-fluid interface at the end 66 of the second microfluidic valve 54 and Laplace pressure generated by the meniscus prevents fluid from flowing in the fluid channel 58.

Upon transitioning the first microfluidic valve 52 to the open state, fluid from the first reservoir 56 flows into the fluid channel 58. Upon contact of the fluid from the first microfluidic valve 52 with the meniscus at the end 66 of the second microfluidic valve 54, the meniscus breaks, thereby allowing fluid to flow from the second reservoir 60 into the fluid channel 58 to transition the second microfluidic valve 54 from a closed state to an open state.

As noted, FIG. 3B illustrates the microfluidic network 50 in the active state. In particular, FIG. 3B illustrates the microfluidic network 50 upon transitioning the first and second microfluidic valves 52 and 54 from the closed state to the open state. In the open state, fluid is mixed and/or compounded in the fluid channel 58. Additionally, in some examples, a vent 68 may be included in the fluid channel 58. The vent 68 releases the inert gas from the fluid channel 58 to expedite the flow of fluid from the first and second reservoirs 56 and 60 into the fluid channel 58.

In some examples, the first microfluidic valve 52 and/or the second microfluidic valve 54 may be designed as (disposable) one-time-open valves. In other examples, the first microfluidic valve 52 and/or the second microfluidic valve 54 may be reused upon transitioning the microfluidic network 50 back to the rest state. To transition the microfluidic network 50 back to the rest state, fluid from the fluid channel 58, as well as fluid from the capillary tube 61 of the first microfluidic valve 52 and from the capillary tube 65 of the second microfluidic valve 54 may be extracted.

By employment of the microfluidic network 50, a composition, timing and/or volume of resulting fluid in the fluid channel 58 may be tightly controlled. For example, by controlling a volume of the fluid channel 58, the volume of the resultant fluid may be controlled. Additionally, in some examples, the fluids in first and second reservoirs 56 and 60 may be different fluids that (when combined) initiate a chemical reaction. In other examples, fluids in first and second reservoirs 56 and 60 may be fluids with a specific molar concentration that (when combined) mix together and result in a fluid with a particular molar concentration.

Figure 4:
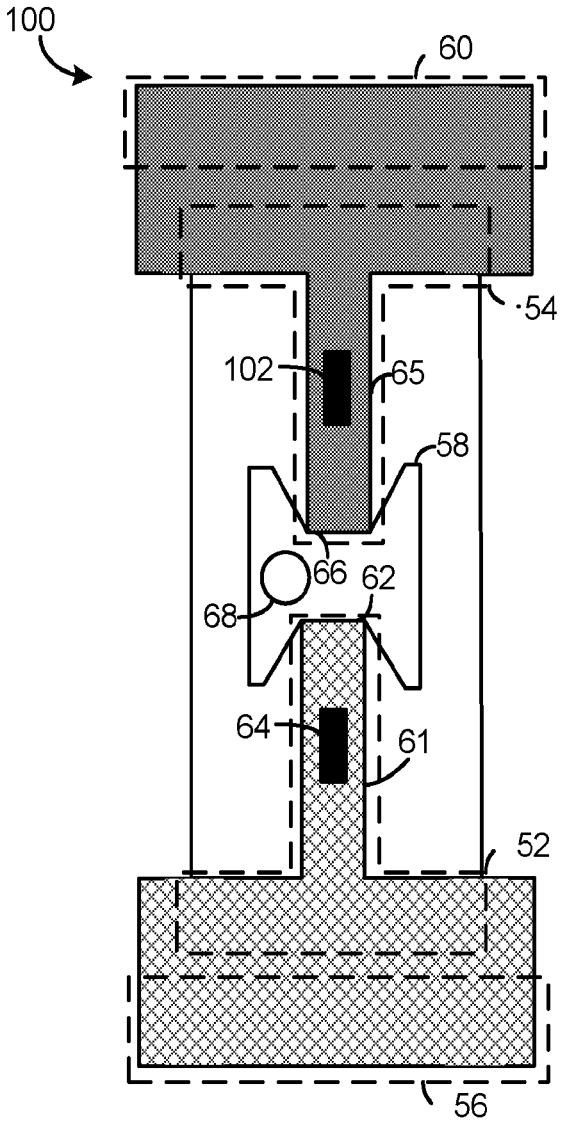
FIG. 4 illustrates another diagram of an example of a microfluidic network.

FIG. 4 illustrates another example of a microfluidic network 100. For purposes of simplification of explanation, the microfluidic network 100 employs the same reference numbers as the microfluidic network 50 illustrated in FIGS. 3A and 3B to denote the same structure. In the microfluidic network 100, the second microfluidic valve 54 includes a fluid agitator 102. The fluid agitator 102 may be actuated by an electrical signal that may be the same or different electrical signal as the electrical signal that actuates the fluid agitator 64 of the first microfluidic valve 52. Upon actuation of the fluid agitator 102 of the second microfluidic valve 54, the second microfluidic valve 54 transitions the second microfluidic valve 54 from the closed state to the open state, such that fluid flows from the second reservoir 60 into the fluid channel 58.

By employment of the microfluidic network 100, the volume, composition and timing of the fluid in the fluid channel 58 may be tightly controlled. In some examples, the fluid agitator 64 of the first microfluidic valve 52 may be actuated a predetermined amount of time before (or after) actuation of the fluid agitator 102 of the second microfluidic valve 54 to allow for specific amounts of the fluid from the first reservoir 56 and the second reservoir 60 to flow into the fluid channel 58. Such control of volumes allows for specific matching of ratios of reactants and reagents. Additionally, in situations where the fluid in the first and second reservoirs 60 are fluids with similar compositions but different molar concentrations, by controlling the timing of opening the first and second microfluidic valves 52 and 54, the resultant fluid in the fluid channel 58 may have a particular molar concentration.

Figure 5A:
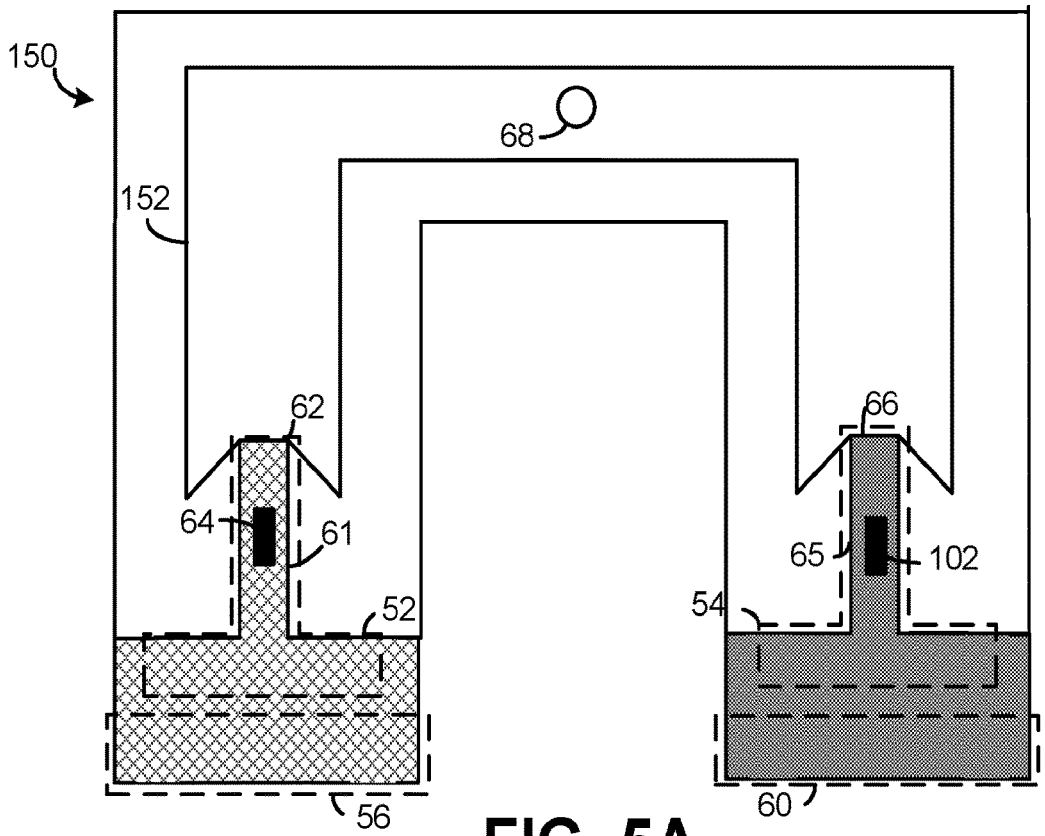
FIGS. 5A and 5B illustrate a diagram of an example of a microfluidic network with an elongated channel.
Figure 5B:
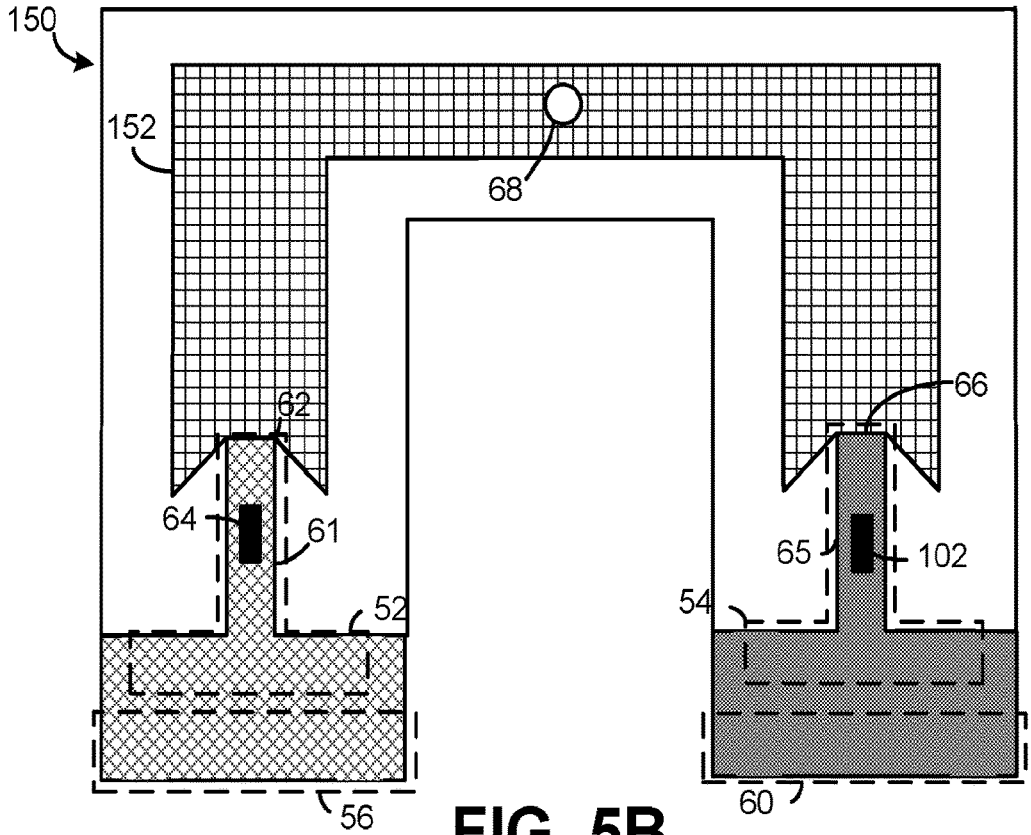

FIGS. 5A and 5B illustrate another example of a microfluidic network 150 that may be employed to implement the microfluidic network 20 of FIG. 2. For purposes of simplification of explanation, the same reference numbers are employed in FIGS. 3A-3B, 4, 5A and 5B to denote the similar structures.

FIG. 5A illustrates the microfluidic network 150 in a rest state and FIG. 5B illustrates the microfluidic network 150 in an active state, subsequent to actuation of the fluid agitators 64 and 102. The microfluidic network 150 includes an elongated fluid channel 152. The elongated fluid channel 152 has particular dimensions (length, width and height) selected to allow a particular volume of fluid to flow from the first and second reservoirs 56 and 60. Moreover, the elongated fluid channel 152 may be shaped to allow for an increased amount of timing between actuation of the first microfluidic valve 52 and the second microfluidic valve 54. Additionally, in some examples, the elongated fluid channel 152 is symmetrically shaped. In other examples, the elongated fluid channel 152 is asymmetrically shaped. The elongated fluid channel 152 may be formed to have nearly any shape (curved, polyhedral, etc.).

Figure 6A:
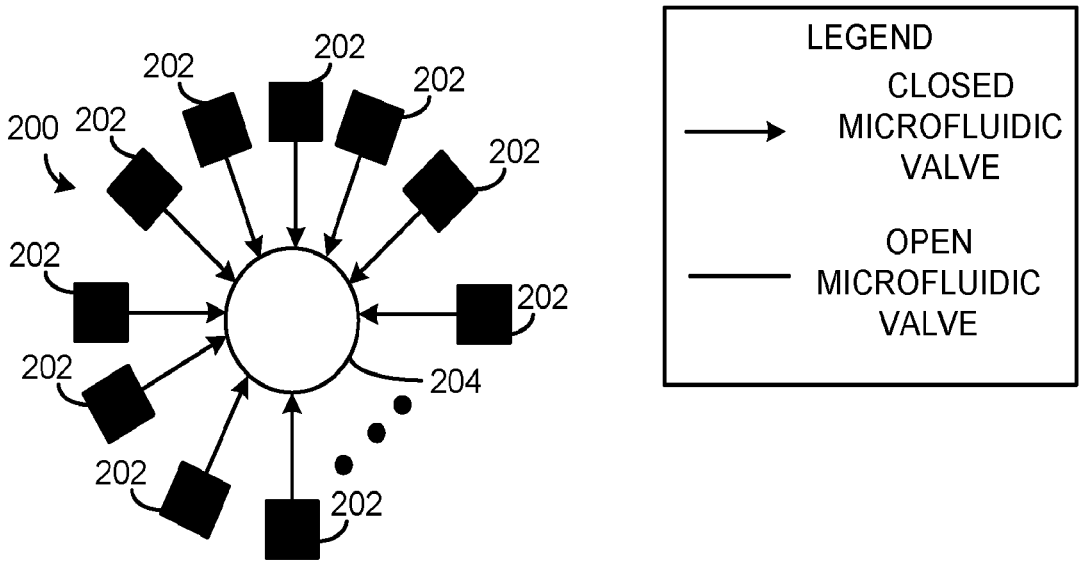
FIGS. 6A and 6B illustrates a diagram of an example microfluidic network for parallel valve opening.
Figure 6B:
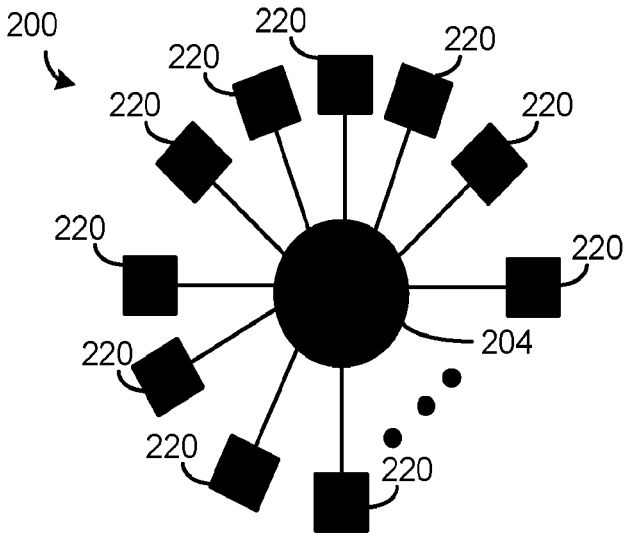

FIGS. 6A and 6B illustrates a block diagram of a microfluidic network 200. The microfluidic network 200 may be employed to implement the microfluidic network 20 of FIG. 2. The microfluidic network 200 may be employed to implement parallel valve opening, in a manner described herein. FIG. 6A illustrates an example of the microfluidic network 200 in a rest state. FIG. 6B illustrates an example of the microfluidic network 200 in an active state. In FIG. 6A, N number of combinations of a microfluidic valves in a closed state and corresponding reservoirs are illustrated as 202, where N is an integer greater than or equal to two. For purposes of simplification of explanation, each combination of a microfluidic valve and a corresponding reservoir in the closed state is referred to as a "closed microfluidic valve" 202. Each closed microfluidic valve 202 may be coupled to a fluid channel that is schematically shown as 204. The fluid channel 204 may be nearly any size and/or shape. However, for purposes of simplification of explanation, the fluid channel 204 is illustrated as being circular.

Fluid flowing to an air-fluid interface at each of the N number of closed microfluidic valves 202 forms a meniscus to prevent (unwanted) fluid flow into the fluid channel 204. At least one of the N number of closed microfluidic valves 202 may include a fluid agitator (e.g., the fluid agitator 30 of FIG. 2) that may be actuated to break each of the N number meniscus (or some subset thereof) to allow fluid to flow into the fluid channel 204 in a manner described herein. In some examples, each of the N number of closed microfluidic valves 202 may include a fluid agitator to allow precise control of a timing of for breaking the meniscuses, as described herein.

Breaking the meniscuses transitions the microfluidic network 200 from the rest state (illustrated in FIG. 6A) to the active state (illustrated in FIG. 6B). In FIG. 6B, N number of a combination of microfluidic valves and corresponding reservoirs are in an open state and corresponding reservoirs are schematically illustrated as 220. For purposes of simplification of explanation, the N number of the combination of microfluidic valves in the open state and the corresponding reservoirs are referred to as "open microfluidic valves" 220. In the microfluidic network 200 illustrated in FIG. 6B (in the active state) fluid flows into the fluid channel 204.

The microfluidic network 200 illustrated in FIGS. 6A and 6B may be deployed in situations where a complex fluid is being synthesized. For example, in some situations, different fluids are synthesized by adding component fluids in a particular order. Accordingly, in at least one example, each of the N number of closed microfluidic valves 202 may control the flow of a different fluid. In such a situation, each of the closed microfluidic valves 202 may be opened (e.g., via actuation of a fluid agitator by an electrical signal) in a specific timing and/or order to provide a resultant fluid (in the fluid channel 204) with a specific volume and/or composition.

Further still, in some examples, multiple closed microfluidic valves 202 may be opened (e.g., in response to an electrical signal to a fluid agitator) nearly simultaneously, which may be referred to as a "parallel valve opening". For example, in the situation where there are four (4) closed microfluidic valves 202, a first and second microfluidic valve 202 may be opened nearly simultaneously (e.g., within about 100 milliseconds). In such a situation, the fluid channel 204 may be shaped to prevent breaking of the meniscus for the third and fourth microfluidic valves 202.

Figure 7A:
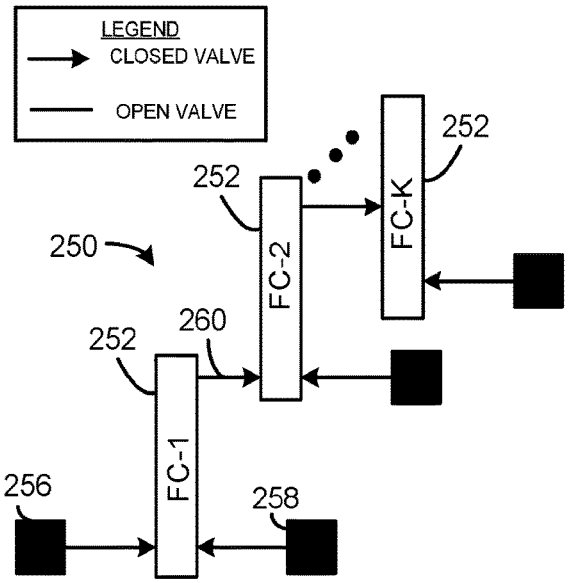
FIGS. 7A, 7B, 7C and 7D illustrate a diagram of a microfluidic network for sequential valve opening.
Figure 7B:
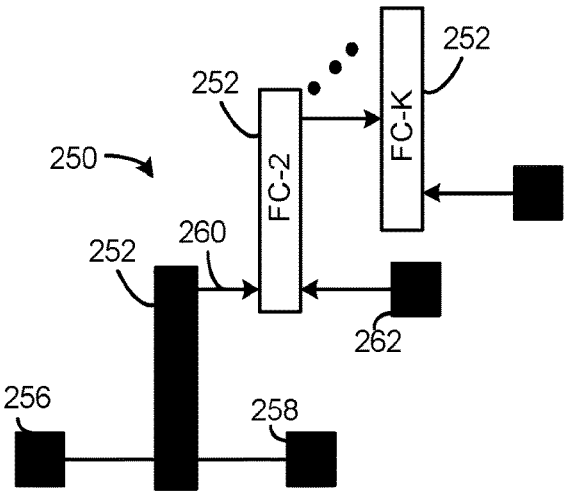
Figure 7C:
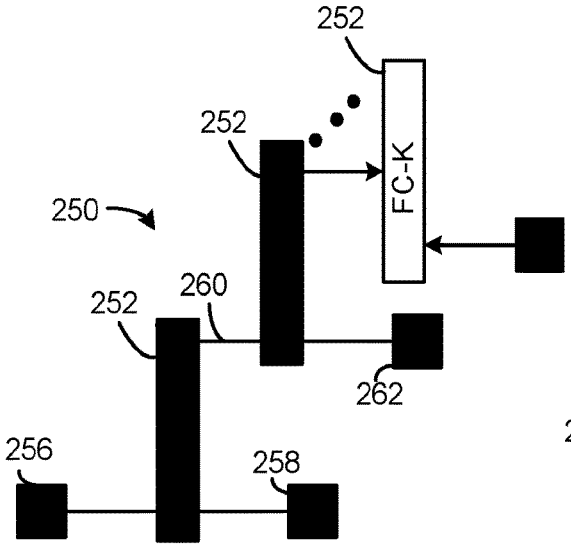
Figure 7D:
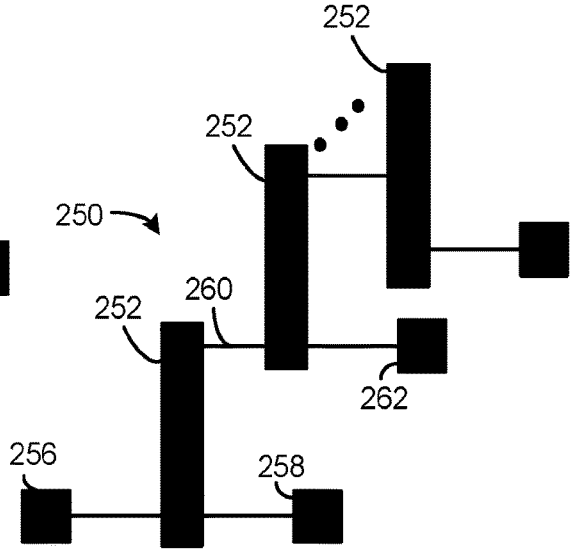

FIGS. 7A, 7B, 7C and 7D illustrate a block diagram of a microfluidic network 250. FIG. 7A illustrates the microfluidic network 250 in a rest state. FIGS. 7B and 7C illustrate the microfluidic network 250 in a transition state (a state between rest and active states) and FIG. 7D illustrates the microfluidic network 250 in an active state. The microfluidic network 250 could be employed to implement the microfluidic network 20 of FIG. 2. The microfluidic network 250 may be employed for sequential valve opening, in a manner described herein.

The microfluidic network 250 includes K number of fluid channels 252 that are interconnected with channel valves, where K is an integer greater than or equal to two. Each fluid channel 252 (or some subset thereof) may be a passive channel that allows fluids present to mix passively. Alternatively, each fluid channel 252 (or some subset thereof) may be an active channel that may include a wiggler mixer, an incubation chamber, a thermocycler or a combination thereof to accelerate a mixing rate. Each channel valve may be implemented in a manner similar to the first microfluidic valve 52 of FIG. 3, where a corresponding fluid channel 252 operates as corresponding reservoir.

In the example illustrated in FIG. 7A, a first fluid channel 252 (labeled as "FC-1" in FIG. 7A) is coupled to two closed microfluidic valves 256 and 258, but more or less microfluidic valves may be coupled to the first fluid channel 252. Additionally, a closed channel valve 260 interconnects the first fluid channel 252 and a second fluid channel 252 (labeled in FIGS. 7A and 7B as FC-2). Upon actuation of a fluid agitator in the closed microfluidic valve 256 and/or a fluid agitator in the closed microfluidic valve 258, the closed microfluidic valves 256 and 258 transition to the open state and fluid flows into the first fluid channel 252 and the microfluidic network 250 transitions to a state illustrated in FIG. 7B.

In the state illustrated in FIG. 7B, the channel valve 260 interconnecting the first fluid channel 252 and the second fluid channel 252 (labeled in 6B as "FC-2") prevents fluid from flowing from the first fluid channel 252 in to the second fluid channel 252. The second fluid channel 252 may be coupled to a closed microfluidic valve 262. In some examples, a meniscus formed at the channel valve 260 may be broken by actuation (in response to an electrical signal) of a fluid agitator in the channel valve 260. In other examples, the closed microfluidic valve 262 may be actuated (e.g., by an electrical signal), and fluid flowing from the closed microfluidic valve 262 may break the meniscus formed at the channel valve 260. In either situation, the microfluidic network 250 transitions from the state illustrated in FIG. 7B to the state illustrated in FIG. 7C. The process is repeated until each of the K number of fluid channels 252 allow a flowing of fluid, as illustrated in FIG. 7D, such that the microfluidic network 250 is in the active state.

The microfluidic network 250 may be employed, for example, where a sequential combination of fluids is needed. For example, in situations where fluid controlled by the microfluidic valve 256 and 258 should be combined prior to combining the resulting mixture/compound with the fluid controlled by the closed microfluidic valve 262, the arrangement illustrated in FIGS. 7A, 7B, 7C and 7D may be used.

Figure 8A:
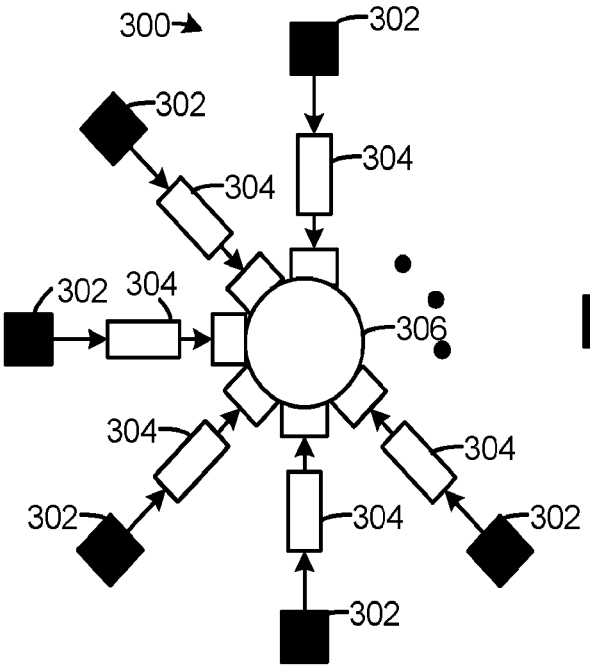
FIGS. 8A, 8B and 8C illustrate a diagram of a microfluidic network for parallel and sequential valve opening.
Figure 8B:
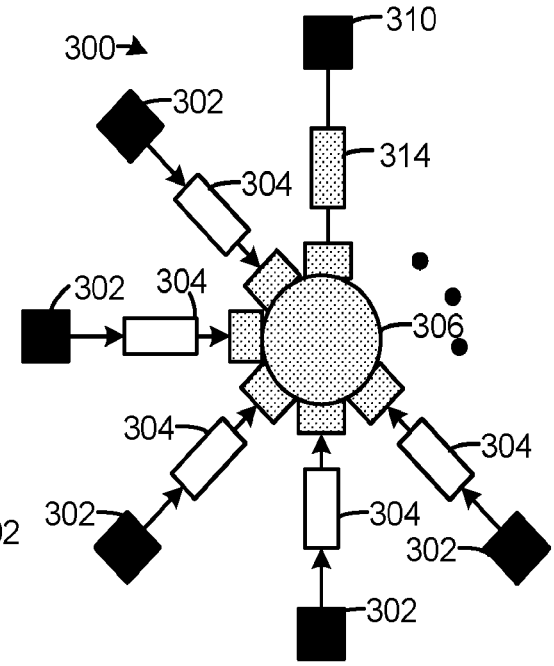
Figure 8C:
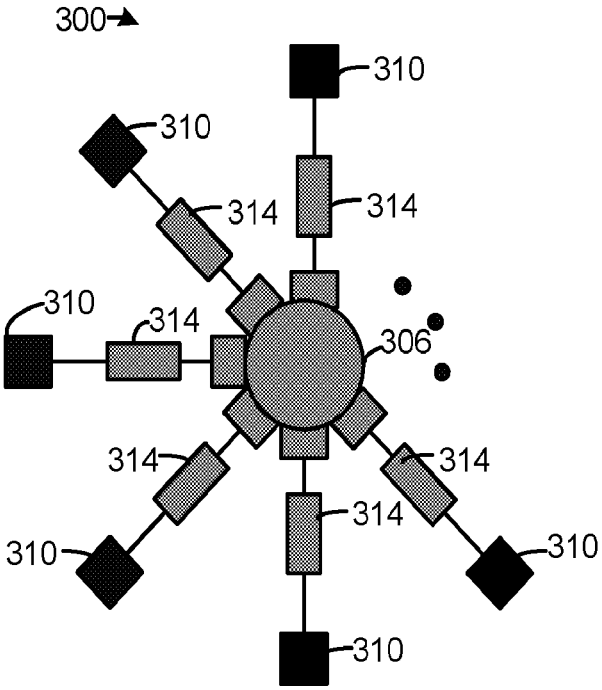
Figure 8C:
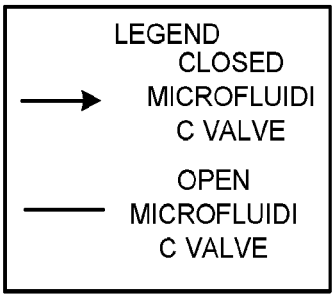

FIGS. 8A, 8B and 8C illustrate a block diagram of a microfluidic network 300. The microfluidic network 300 could be employed to implement the microfluidic network 20 of FIG. 2. FIG. 8A illustrates the microfluidic network 300 in a rest state. FIG. 8B illustrates the microfluidic network 300 in a transition state and FIG. 8C illustrates the microfluidic network 300 in an active state.

In FIG. 8A, the microfluidic network 300 may include J number of closed microfluidic valves 302, where J is an integer greater than or equal to three. Each of the J number of closed microfluidic valves 302 may be coupled to a buffer channel 304. Each buffer channel 304 may also be coupled to a fluid channel 306 via another microfluidic valve.

Inclusion of the buffer channel 304 prevents an unintended flowing of fluid, as described herein. For instance, as illustrated in FIG. 8B a given closed microfluidic valve 310 may be opened (e.g., in response to an electrical signal). In such a situation, fluid flows into a corresponding buffer channel 314. Moreover, the microfluidic valve between the buffer channel 314 and the fluid channel 306 may be opened, such that fluid flows into the fluid channel 306. However, due to the remaining buffer channels 304, additional fluid is prevented from flowing into the fluid channel 306. That is, the inclusion of the buffer channels 304 prevents an unintended breaking of a meniscus.

Additionally, sequentially and/or concurrently, the remaining J-1 closed microfluidic valves 302 (and microfluidic valves of corresponding buffer channels 304) may be opened (resulting in open microfluidic valves 310) to allow additional fluid to flow into the fluid channel 306, as illustrated in FIG. 8C.

The microfluidic network 300 may be employed, for example, where both sequential and parallel opening of the closed microfluidic valves 302 is needed. For example, in situations where complex DNA and/or medicine synthesis is being implemented, the tightly controlled order and volume of a mixing of fluids may be needed.

Figure 9:
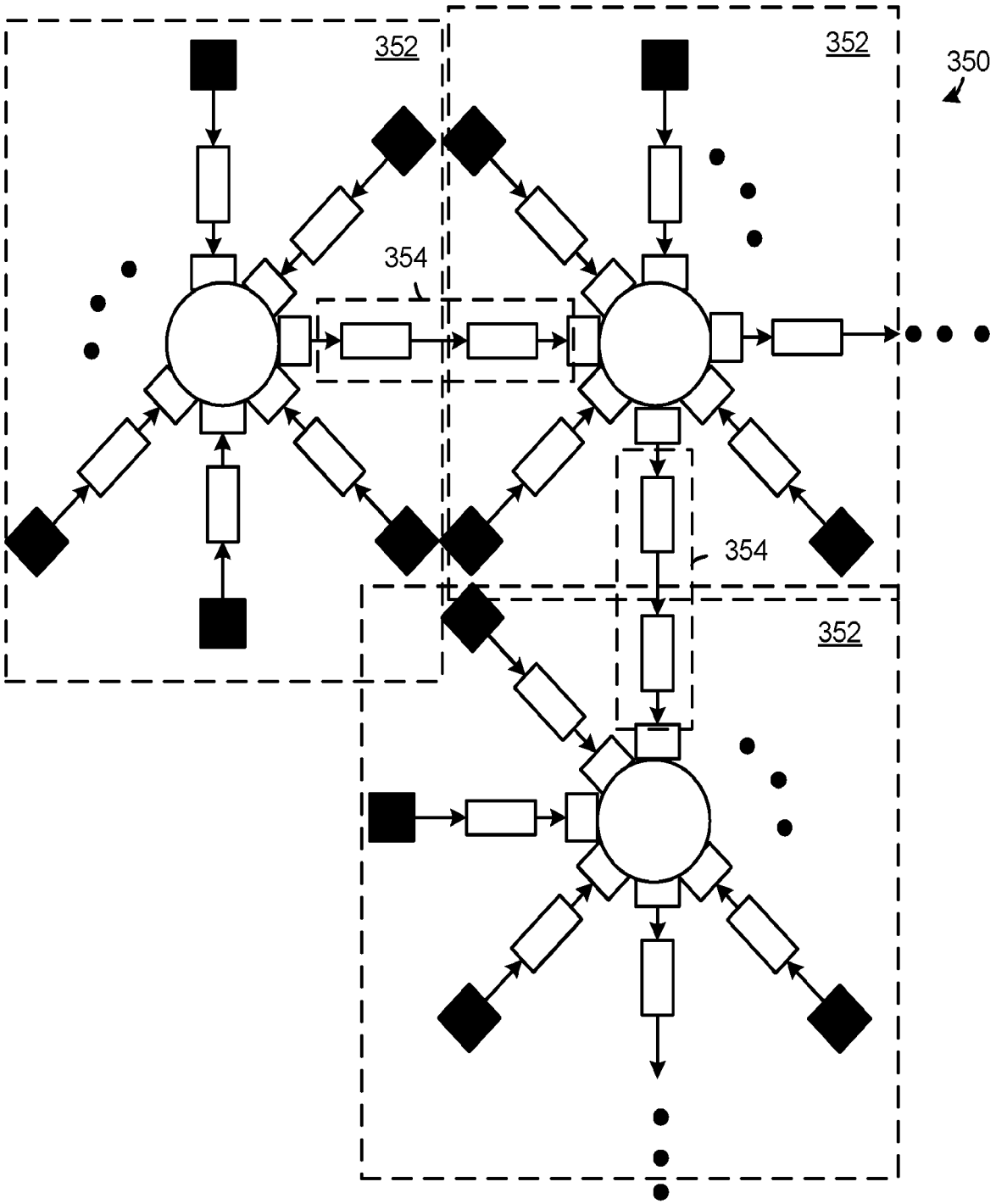
FIG. 9 illustrates a microfluidic network of interconnected microfluidic network modules.

FIG. 9 illustrates another block diagram of an example of a microfluidic network 350. The microfluidic network 350 may be employed to implement the microfluidic network 20 of FIG. 2. The microfluidic network 350 may also be referred to as an active capillary valve switch board. The microfluidic network 350 may include R number of microfluidic network modules 352, wherein each microfluidic network module 352 may be implemented similar to the microfluidic network 300 of FIGS. 8A, 8B and 8C. R is an integer greater than or equal to two. Each microfluidic network module 352 is interconnected with at least one other microfluidic network module 352 via a channel valve 354. The channel valve 354 may include, for example, a plurality of buffer channels and corresponding microfluidic valves that controls the flow of fluid between a fluid channel of a given microfluidic network module 352 and a fluid channel of another microfluidic network module 352. Accordingly, the microfluidic network module 352 may be arranged in nearly any order. In some examples, there may be a two or three-dimensional array of the R number of microfluidic network module 352.

In operation, each of a plurality (or a single) of microfluidic valves may be opened to allow fluid to flow into one or more fluid channels of the microfluidic network module 352, in a manner described herein. Moreover, at a desired time, each of the channel valves 354 may be opened to allow fluid to flow between the microfluidic network module 352.

The microfluidic network 350 may be employed for example, where both sequential and parallel opening of the closed microfluidic valve 302 is needed. For example, in situations where complex DNA and/or medicine synthesis is being implemented, the tightly controlled order and volume of a mixing of fluids may be needed.

Figure 10:
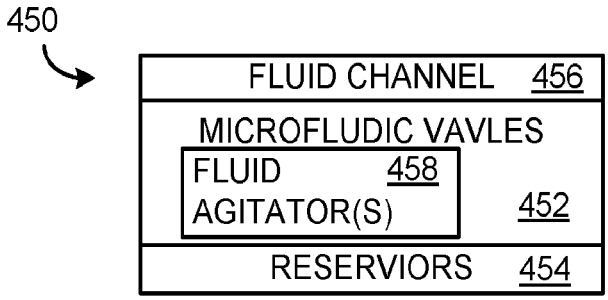
FIG. 10 illustrates yet another block diagram of an example of a microfluidic network.

FIG. 10 illustrates another example of a microfluidic network 450 that may be employed to implement the microfluidic network 20 of FIG. 2. The microfluidic network 450 may include a plurality of microfluidic valves 452 coupled between respective reservoirs 454 and a fluid channel 456. A subset (one or more) of the of the plurality of microfluidic valves 452 may include a fluid agitator 458 to break a meniscus formed at an air-fluid interface and release fluid from corresponding reservoirs 454 in response to an electrical signal. Fluid from each of the respective reservoirs may mix in the fluid channel 456.

Figure 11:
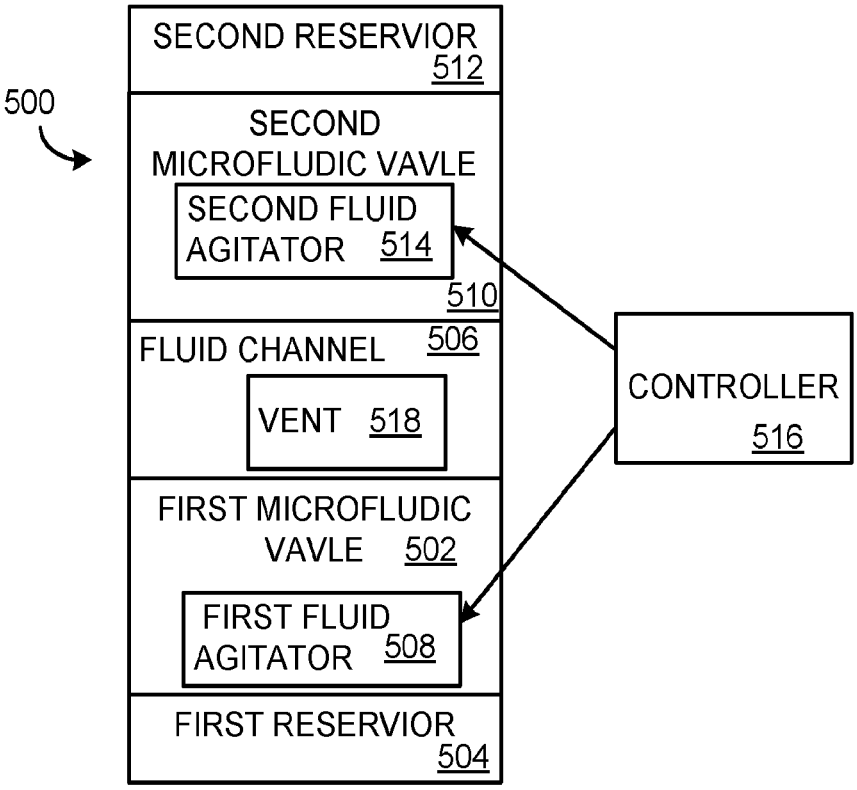
FIG. 11 illustrates still yet another block diagram of an example of a microfluidic network.

FIG. 11 illustrates yet another example of a microfluidic network 500 that may be employed to implement the microfluidic network 20 of FIG. 2. The microfluidic network 500 may include a first microfluidic valve 502 coupled between a first reservoir 504 and a fluid channel 506. The first microfluidic valve 502 may include a first fluid agitator 508 to break a first meniscus formed at an air-fluid interface and release fluid from the first reservoir 504 into the fluid channel 506 in response to a first electrical signal. The microfluidic network 500 may also include a second microfluidic valve 510 coupled between a second reservoir 512 and the fluid channel 506. The second microfluidic valve 510 may include a second fluid agitator 514 to break a second meniscus formed at an air-fluid interface and release fluid from the second reservoir 512 into the fluid channel 506 in response to a second electrical signal.

The microfluidic network 500 may further include a controller 516 that provides the first and the second electrical signal to the respective first fluid agitator 508 and the second fluid agitator 514. The fluid channel 506 may include a vent 518 that releases gas in the fluid channel to draw fluid from the first reservoir 504 and the second reservoir 512 into the fluid channel 506. Fluid from the first reservoir 504 and fluid from the second reservoir 512 mix in the fluid channel 506.

What have been described above are examples. It is, of course, not possible to describe every conceivable combination of structures, components, or methods, but one of ordinary skill in the art will recognize that many further combinations and permutations are possible. Accordingly, the invention is intended to embrace all such alterations, modifications, and variations that fall within the scope of this application, including the appended claims. Where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus comprising:

a first microfluidic valve coupled between a first reservoir and a fluid channel, the first microfluidic valve comprising a first tube connected to the first reservoir and the fluid channel and a fluid agitator positioned within the first tube to break a meniscus formed at an air-fluid interface and release a first fluid from the first reservoir into the fluid channel in response to an electrical signal; and a second microfluidic valve coupled between a second reservoir and the fluid channel;

wherein, in response to the break of the meniscus, the fluid channel is in fluidic communication with the first reservoir and the second reservoir, and the first fluid from the first reservoir and a second fluid from the second reservoir mix in the fluid channel, and wherein the fluid channel is disposed between the first reservoir and the second reservoir.

2. The apparatus of claim 1, wherein the first fluid flowing into the fluid channel from the first reservoir breaks a meniscus formed at an air-fluid interface of the second microfluidic valve and releases the second fluid from the second reservoir into the fluid channel.

3. The apparatus of claim 1, wherein the fluid agitator of the first microfluidic valve is a first fluid agitator and the second microfluidic valve comprises a second tube connected to the second reservoir and the fluid channel and a second fluid agitator disposed within the second tube that breaks a meniscus formed at an air-fluid interface of the second microfluidic valve and releases the second fluid from the second reservoir into the fluid channel in response to one of the first electrical signal and a second electrical signal.

4. The apparatus of claim 1, wherein the first microfluidic valve, the second microfluidic valve, the fluid channel, the first reservoir and the second reservoir are integrated on and form part of a microfluidic device, the apparatus further comprising a controller that provides the electrical signal.

5. The apparatus of claim 4, wherein the fluid agitator comprises a thermal inkjet resistor that heats the first fluid in the first microfluidic valve to vaporize a portion of the first fluid in the first microfluidic valve in response to the electrical signal.

6. The apparatus of claim 4, wherein the fluid agitator comprises a piezoelectric device that vibrates the first fluid in the first microfluidic valve in response to the electrical signal.

7. The apparatus of claim 1, wherein the fluid channel comprises a vent that releases gas present in the fluid channel to draw the first fluid from the first reservoir and the second fluid from the second reservoir into the fluid channel.

8. The apparatus of claim 1, further comprising:

a second fluid channel; and a channel valve interconnecting the fluid channel and the second fluid channel, the channel valve comprising a second fluid agitator to break a meniscus formed at an air-fluid interface and release fluid from the fluid channel into the second fluid channel in response to another electrical signal.

9. The apparatus of claim 1, wherein the fluid channel comprises at least one of a wiggle mixer, an incubation chamber, a thermocycler a mixer to mix fluids present in the fluid channel.

10. An apparatus comprising:

a plurality of microfluidic valves coupled between a plurality of reservoirs and a fluid channel, a subset of the plurality of microfluidic valves comprising a tube connected to a corresponding reservoir of the plurality reservoirs and the fluid channel and a fluid agitator positioned within the tube to break a meniscus formed at an air-fluid interface and release fluids from the corresponding reservoirs in response to an electrical signal; and wherein, in response to the break of the meniscuses, the fluid channel is in fluidic communication with the corresponding reservoirs and the fluids from each of the corresponding reservoirs mix in the fluid channel, and wherein the fluid channel is disposed between each of the plurality of reservoirs.

11. The apparatus of claim 10, further comprising a plurality of buffer channels, wherein each buffer channel is coupled between a corresponding one of the plurality of microfluidic valves and the fluid channel, wherein each of the plurality of buffer channels is connected to one of the microfluidic valves comprising a fluid agitator to break a meniscus that releases the fluid from the corresponding microfluidic valve into the fluid channel in response to an electrical signal.

12. The apparatus of claim 11, further comprising a controller that provides electrical signals to the fluid agitators to control the fluid agitators of the microfluidic valves and the buffer channels.

13. The apparatus of claim 12, wherein the controller is to provide the electrical signals to the subset of the fluid agitators in a given period of time and the controller is to provide additional electrical signals to another subset of the fluid agitators in another period of time to control a timing of the release of the fluids from the corresponding reservoirs into the fluid channel.

14. The apparatus of claim 10, wherein the fluid channel is a first fluid channel and the first fluid channel is coupled to a channel valve that interconnects the first fluid channel with a second fluid channel.

15. An apparatus comprising:

a first microfluidic valve coupled between a first reservoir and a fluid channel, the first microfluidic valve comprising a first tube connected to the first reservoir and the fluid channel and a first fluid agitator positioned within the first tube to break a first meniscus formed at an air-fluid interface and release a first fluid from the first reservoir into the fluid channel in response to a first electrical signal; and a second microfluidic valve coupled between a second reservoir and the fluid channel, the second microfluidic valve comprising a second tube connected to the second reservoir and the fluid channel and a second fluid agitator to break a second meniscus formed at an air-fluid interface and release a second fluid from the second reservoir into the fluid channel in response to a second electrical signal, wherein the fluid channel is disposed between the first reservoir and the second reservoir; and a controller that provides the first and the second electrical signals;

wherein the fluid channel comprises a vent that releases gas in the fluid channel to draw the first fluid and the second fluid from the first reservoir and the second reservoir into the fluid channel and wherein, in response to the break of the first meniscus and the second meniscus, the fluid channel is in fluidic communication with the first reservoir and the second reservoir and the first fluid from the first reservoir and the second fluid from the second reservoir mix in the fluid channel.

16. The apparatus of claim 15, wherein the first tube and the second tube include capillary tubes, and the first fluid and second fluid are different from one another.

17. The apparatus of claim 15, wherein the fluid channel is coupled between the first reservoir and the second reservoir respectively via the first microfluidic valve and the second microfluidic valve.

18. The apparatus of claim 1, wherein the fluid channel is coupled to each of the first reservoir and the second reservoir, and in response to the break of the first meniscus and the second meniscus, the fluid channel is in fluidic communication with each of the first reservoir and the second reservoir; and the first fluid from the first reservoir and the second fluid from the second reservoir mix in the fluid channel.

19. The apparatus of claim 1, further including a controller to provide the electrical signal to the fluid agitator to release the first fluid and the second fluid from the first reservoir and the second reservoir into the fluid channel.

20. The apparatus of claim 10, wherein the fluid channel is coupled to each of the plurality of channels, and in response to the break of the meniscus, the fluid channel is in fluidic communication with the corresponding reservoirs of the plurality.

* * * * *